United States Patent [19]

Gutridge et al.

[11] 4,179,996

[45] Dec. 25, 1979

[54] FIXTURE FOR PASSENGER RAILWAY CAR COMPARTMENT

[75] Inventors: Jack E. Gutridge, Dyer; Ronald W. Marsh, Michigan City, both of Ind.

[73] Assignee: Pullman Incorporated, Chicago, Ill.

[21] Appl. No.: 859,426

[22] Filed: Dec. 12, 1977

[51] Int. Cl.[2] ..... B61D 1/08; B61D 31/00

[52] U.S. Cl. ..... 105/345; 105/326; 182/35; 105/319

[58] Field of Search ..... 105/314, 326, 315, 321, 105/344–347, 316, 324, 319; 182/33.3, 28, 119, 21, 35, 39; 52/36; 5/9 R; 248/118; 297/412–413

[56] References Cited

U.S. PATENT DOCUMENTS

| | | | |
|---|---|---|---|
| 487,117 | 11/1892 | Fauner | 182/35 |
| 1,293,967 | 2/1919 | Stalder | 182/35 |
| 2,346,878 | 4/1944 | Tully et al. | 105/319 |
| 2,567,894 | 9/1951 | Reinke et al. | 105/315 |
| 4,015,542 | 4/1977 | Gutridge et al. | 105/345 |
| 4,046,081 | 9/1977 | Gutridge et al. | 105/326 |

*Primary Examiner*—Stephen G. Kunin
*Assistant Examiner*—Lawrence E. Williams
*Attorney, Agent, or Firm*—Richard J. Myers

[57] ABSTRACT

A railway passenger car compartment includes an upper berth and a convertible seat. The compartment is provided with a fixture adjacent to the seat which serves as a storage unit, as a ladder to provide access to the upper berth, as an arm rest for the seat, and as an instrument panel for various electrical components.

8 Claims, 3 Drawing Figures

FIXTURE FOR PASSENGER RAILWAY CAR COMPARTMENT

BACKGROUND OF THE INVENTION

1. Field of the Invention

The field of invention pertains to railway passenger car compartments having sleeping and seating components therein. More specifically it relates to a fixture adjacent to the seating components having a multiple number of uses to accommodate the comfort of the passenger.

2. Description of the Prior Art

Patents pertinent to the present invention are U.S. Pat. No. 428,258, patented May 20, 1890, U.S. Pat. No. 1,557,342, Oct. 13, 1925, U.S. Pat. No. 2,567,894, Sept. 11, 1951, and U.S. Pat. No. 3,811,533, May 21, 1974. U.S. Pat. Nos. 428,258 and 2,567,894 show arrangements for railway passenger car compartments wherein various fixtures are incorporated into the interior of the compartment for use by a passenger. U.S. Pat. Nos. 1,557,342 and 3,811,533 show arrangements for furniture wherein movable elements permit usage in a variety of ways. The subject invention is an improvement over these designs.

SUMMARY OF THE INVENTION

The present invention relates to a fixture for a passenger railway compartment which includes an upper berth and a convertible seat adapted to be utilized as a second berth. The fixture is positioned adjacent to the convertible seat and includes a lower base in contiguous relation with the floor of the car providing a first shelf and also a first step when the fixture is utilized as a ladder to provide access to the upper berth when the upper berth is in a lowered sleeping position. The fixture also includes second and third shelves which also serve as steps and can be utilized for storage purposes. The fixture is provided with a projected armrest for the comfort of the passenger seated on the convertible seat. Also the fixture includes a boxlike structure having an instrument panel providing ready access to electrical devices such as a call button switch, a light switch, and an electrical receptacle.

DESCRIPTION OF THE PREFERRED EMBODIMENT

Figure 1:
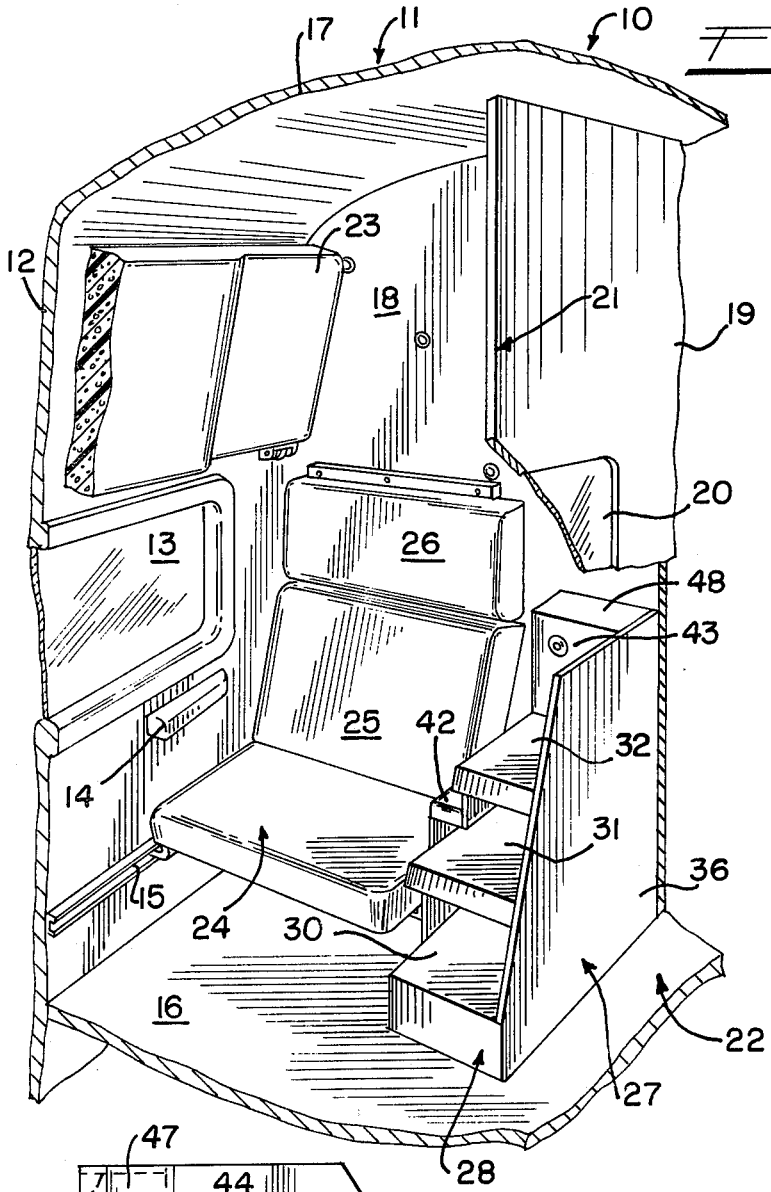
FIG. 1 is a perspective view of approximately ½ portion of a passenger railway compartment, the other half being substantially symmetrical.

A passenger car compartment, disclosed in FIG. 1, is formed within a car body 11 having a side wall 12, provided with a window 13 below which is positioned an outer arm rest 14. The car body 11 also includes a lower track 15 adapted to support a convertible seat and bed construction designated at 24. The car compartment 10 is provided with a floor 16 and a roof structure 17. The car compartment includes partition walls 18, only one of which is shown since only approximately one-half of the compartment is disclosed, the other half being substantially symmetrical. The partition walls 18 extend inwardly from the side wall 12 and are connected by a divider wall 19 provided with a suitable window 20. The divider wall 19 ends in a doorway 21 and is provided with a suitable door which encloses the doorway in combination with another similar divider wall of the compartment (not shown). The divider walls 19 are positioned adjacent to a conventional aisle 22 providing access into the compartment.

The compartment is provided with an upper berth 23 which is shown in the non-use hinged position which may be lowered horizontally to provide a suitable bed in conventional fashion. The convertible seat and bed 24 are supportive on a track 15 and similar track not shown which may be supported on the fixture 27. The construction is such that the seat 24 and back 25 may be moved downwardly into a flat, horizontal position with a similar convertible seat portion disposed in the other half of the compartment which then forms an elongated sleeping berth. Above the seat back 25 there is provided a head rest 26 which is mounted on one of the partitions 18.

Figure 2:
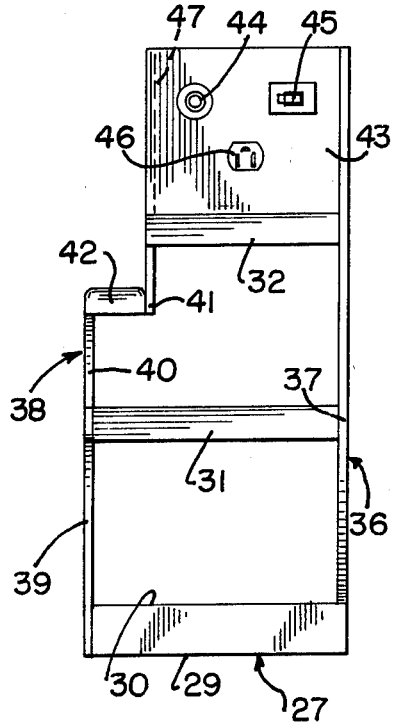
FIG. 2 is a front elevational view of a fixture for a passenger compartment having multiple uses.
Figure 3:
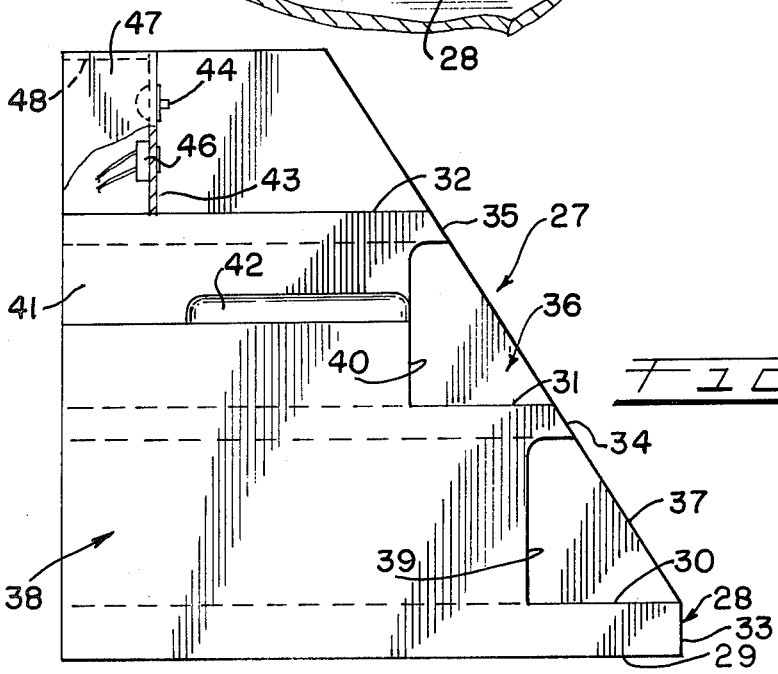
FIG. 3 is a side elevational view, partially in section, of the fixture disclosed in FIG. 2.

The present invention comprises a fixture generally designated at 27 which is supported immediately adjacent to the convertible seat 24 and is contiguous with the divider wall 19. The fixture 27 includes a base 28 having a lower flat surface 29 which is contiguous with and seated upon the floor 16. The base 28 is of a substantial height and is provided with a first shelf 30. The fixture also includes second and third shelves 31 and 32, respectively disposed above the base 28 or first shelf 30. As best shown in FIG. 3, the first shelf 30 is provided with a frontal edge portion 33, the second shelf 31 is provided with a frontal edge portion 34, and the third shelf 32 is provided with a frontal edge portion 35. The frontal edge portion 34 is spaced rearwardly or inwardly of the frontal edge portion 33 and the frontal edge portion 35 of the third shelf 32 is spaced rearwardly or inwardly of the frontal edge portion 34. Thus, by this positioning of the frontal edge portions of the shelves, a suitable ladder arrangement is provided which may be used for access to the upper berth of the compartment. The shelves 30, 31, and 32 are supported on an in board vertical side panel 36 having a diagonal edge 37 joining the frontal edge portions 33, 34, and 35. The side panel 36 is placed in contiguous relation with the divider wall 19 as indicated in FIG. 1. As best shown in FIGS. 2 and 3 the fixture includes a first outboard side panel 38 cut out as indicated at 39 and 40 to accommodate use as a ladder by a traveler to secure access to the upper berth. As best shown in FIGS. 1 and 2, a second outboard side panel 41 is spaced inwardly of the panel 38 and also serves to support a cushioned arm rest 42 which is conveniently available to a person sitting on the convertible seat 24. Thus, the shelf 32 is substantially less wide than the shelves 30 and 31, yet the shelf 32 may easily be utilized as a third step by the passenger, using the fixture 24 as a ladder to gain access to the upper berth.

The fixture 27 also includes a transversely extending vertical instrument panel 43 which is positioned a distance rearwardly from the frontal edge portion 35 of the shelf 32 and which is suitably enclosed by a vertical outboard panel 47 and a top closure panel 48, which with the partition wall 18 and divider wall 19 provides a box-like enclosure. The instrument panel 43 is adapted to support a call button switch 44, a light switch 45 and an electrical receptacle 46, which all may be suitably wired and thus provide for easy access and use by the passenger seated on the convertible seat 24.

In use, the passenger uses the arm rests 14 and 42 to secure a comfortable seating position. When it is desired to utilize the upper berth 23 it is merely swung down into a horizontal position and the passenger may utilize the shelves 30, 31, and 32 as steps of a ladder to gain access to the upper berth. Those portions of the fixture 27 between the shelves and rearwardly of the cut outs 39 and 40 can also be used for storage of small items, luggage, etc.

Thus, the construction of the fixture disclosed provides for a multiplicity of uses and conveniences and serves to increase the comfort of the railway passenger.

What is claimed is:

1. For a railway passenger car compartment including a floor, an outer car wall, inner longitudinally spaced partition walls, a divider wall connected to said partition walls, said divider wall extending substantially parallel to rail outer car wall and positioned adjacent to an access aisle, said compartment including a hinged bed supported on said outer wall, a convertible seat and passenger bed arrangement adjacent to one of said partition walls, the improvement comprising;

a fixture including a base portion positioned adjacent to said seat and passenger bed and said divider wall, said base including a first shelf having a lower horizontal surface contiguous with and supported on said floor, a second shelf, supported on and above said first shelf, said second shelf having its terminal frontal portion spaced longitudinally inwardly with respect to a frontal portion of said first shelf, a third shelf supported on said base above said second shelf, said third shelf having a terminal frontal portion spaced longitudinally inwardly with respect to the frontal portion of said second shelf, an arm rest positioned between said second and third shelves and incorporated within outboard side panel means and adjacent to said convertible seat and passenger bed, said outboard side panel means including a first outboard side panel connecting outboard side edges of said first and second shelves and said arm rest, and a second outboard side panel connecting an inboard side edge of said arm rest and an outboard side edge of said third shelf, said first outboard side panel having a first edge portion extending between said first and second shelves and spaced inwardly with respect to the terminal frontal edge portion of said second shelf, said first outboard side panel having a second edge portion extending between said second shelf and said arm rest and spaced inwardly with respect to the terminal frontal edge portion of said third shelf, and said second outboard side panel having a third edge portion generally vertically aligned with said second edge portion of said first outboard side panel.

2. The invention in accordance with claim 1, the outboard side edge of said arm rest being substantially flush with outboard side edges of said first and second shelves.

3. The invention in accordance with claim 1, including a first inboard panel connecting inboard side edges of said first, second and third shelves.

4. The invention in accordance with claim 3, said first inboard panel being contiguous with said divider wall at said compartment.

5. The invention in accordance with claim 4, said first shelf having a vertical thickness from its lower surface to its upper surface greater than the thickness of said second and third shelves.

6. The invention in accordance with claim 1, including a vertical transverse panel connected to said third shelf and projecting upwardly with respect thereto, for accommodating instrumentation.

7. The invention in accordance with claim 6, said vertical instrument panel being spaced between the frontal and rear portions of said third shelf.

8. The invention in accordance with claim 7, including an outboard closure panel and a top horizontal panel connected to said instrument panel and with a partition wall and said divider wall forming a box-like enclosure.

* * * * *